US008136684B2

(12) United States Patent
Becotte

(10) Patent No.: US 8,136,684 B2
(45) Date of Patent: Mar. 20, 2012

(54) BOTTLE THAT CAN TRANSFORM INTO A WHISTLE

(76) Inventor: Antoine Becotte, Montreal (CA)

( * ) Notice: Subject to any disclaimer, the term of this patent is extended or adjusted under 35 U.S.C. 154(b) by 301 days.

(21) Appl. No.: 12/626,591

(22) Filed: Nov. 25, 2009

(65) Prior Publication Data

US 2010/0140211 A1 Jun. 10, 2010

Related U.S. Application Data

(60) Provisional application No. 61/119,726, filed on Dec. 4, 2008.

(51) Int. Cl.
*A63H 5/00* (2006.01)

(52) U.S. Cl. .. 215/386; 229/103.1; 446/81; 446/484.73; 215/387; 215/390; 215/382

(58) Field of Classification Search ..... 215/386, 215/387, 390, 382; 220/703, DIG. 13; 116/137 R, 116/67 R; 446/81, 484, 73; 229/103.1
See application file for complete search history.

(56) References Cited

U.S. PATENT DOCUMENTS

| | | | | |
|---|---|---|---|---|
| 1,687,086 | A | 9/1928 | Erb | |
| 2,959,889 | A * | 11/1960 | Gausewitz | 446/166 |
| 3,129,528 | A * | 4/1964 | Gausewitz | 446/153 |
| 3,230,661 | A | 1/1966 | Gleason | |
| 4,398,491 | A * | 8/1983 | Fridl et al. | 116/67 R |
| 4,618,066 | A | 10/1986 | Vail | |
| 4,925,470 | A * | 5/1990 | Chou | 62/4 |
| 6,129,265 | A | 10/2000 | Perryman et al. | |
| 6,299,006 | B1 | 10/2001 | Samonek | |
| 6,439,419 | B1 * | 8/2002 | Darabi | 220/703 |
| 2002/0195043 | A1 * | 12/2002 | Stawski et al. | 116/137 R |
| 2004/0206224 | A1 | 10/2004 | Cohen | |
| 2005/0014439 | A1 | 1/2005 | Erickson et al. | |
| 2005/0178774 | A1 | 8/2005 | Howell | |

FOREIGN PATENT DOCUMENTS

| | | |
|---|---|---|
| CA | 2627116 | 9/2008 |
| CN | 2484276 | 3/2002 |
| CN | 2798687 | 7/2006 |

* cited by examiner

*Primary Examiner* — Anthony Stashick
*Assistant Examiner* — Cynthia Collado

(57) ABSTRACT

A vessel adapted to hold a liquid and having a top portion and bottom portion, the top portion having an opening adapted for the injection of and the removal of the liquid, the bottom portion having an opening including threads. A whistle member capable of producing a whistling sound, the whistle member including threads adapted to be removably attached to the opening of the bottom portion of the vessel by interacting with the threads of the opening, such that after the liquid is removed from the vessel the whistle can be removed from the bottom portion and used to produce whistling sounds.

5 Claims, 3 Drawing Sheets

BOTTLE THAT CAN TRANSFORM INTO A WHISTLE

This application claims priority based on provisional application 61/119,726 filed Dec. 4, 2008

FIELD OF THE INVENTION

The present invention relates generally to sound producing devices but more particularly to a drinking bottle that can transform into a whistle when empty.

BACKGROUND OF THE INVENTION

In sporting events, rabid fans will use various implements to produce loud cheering sounds. There exists a wide variety of such implements.

SUMMARY OF THE INVENTION

In view of the foregoing disadvantages inherent in the known devices now present in the prior art, the present invention, which will be described subsequently in greater detail, is to provide objects and advantages which are:

To provide for an implement having a dual use. The first use is to provide a beverage and the second use is to provide a sound producing instrument which produces sound when blowing through it.

To attain these ends, the present invention generally comprises a vessel adapted to hold a liquid therein and having a top portion and bottom portion, the top portion having an opening adapted for the injection of and the removal of the liquid, the bottom portion having an opening including threads; a whistle member capable of producing a whistling sound, the whistle member including threads adapted to be removably attached to the opening of the bottom portion of the vessel by interacting with the threads of the opening, such that after the liquid is removed from the vessel the whistle can be removed from the bottom portion and used to produce whistling sounds.

The whistle member further includes a body portion which includes the threads, and further includes at least one hole adapted for air to pass therethrough; and a cap portion that is adapted to rotate with respect to the body portion and includes at least one hole adapted for air to pass therethrough, such that when the at least one hole of the cap portion is aligned with the at least one hole of the body portion air can pass therethrough and produce a whistling sound.

The cap portion of the whistle member further includes a tab member to aid in the rotation of the cap portion with respect to the body portion.

The body portion of the whistle member further includes a peel off pad adapted to seal off the liquid from entering the whistle member when the vessel has liquid therein, and which is adapted to be peeled off of the body portion when the vessel is empty and when the whistle is removed and ready to be used to produce a whistling sound.

Additionally, the whistle member can be used by itself to produce a whistling sound. The whistle member can be reattached to the bottom portion of the vessel, such that the vessel and the whistle can be used together to produce a whistling sound.

When the whistle member is reattached to the bottom portion of the vessel, the tab member can be further rotated upon the body portion until the holes of the body portion and the tab member are aligned.

The material used to form the vessel and whistle member is chosen from a group including plastics, metals, and ceramics.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter which contains illustrated preferred embodiments of the invention.

DETAILED DESCRIPTION

Figure 1A:
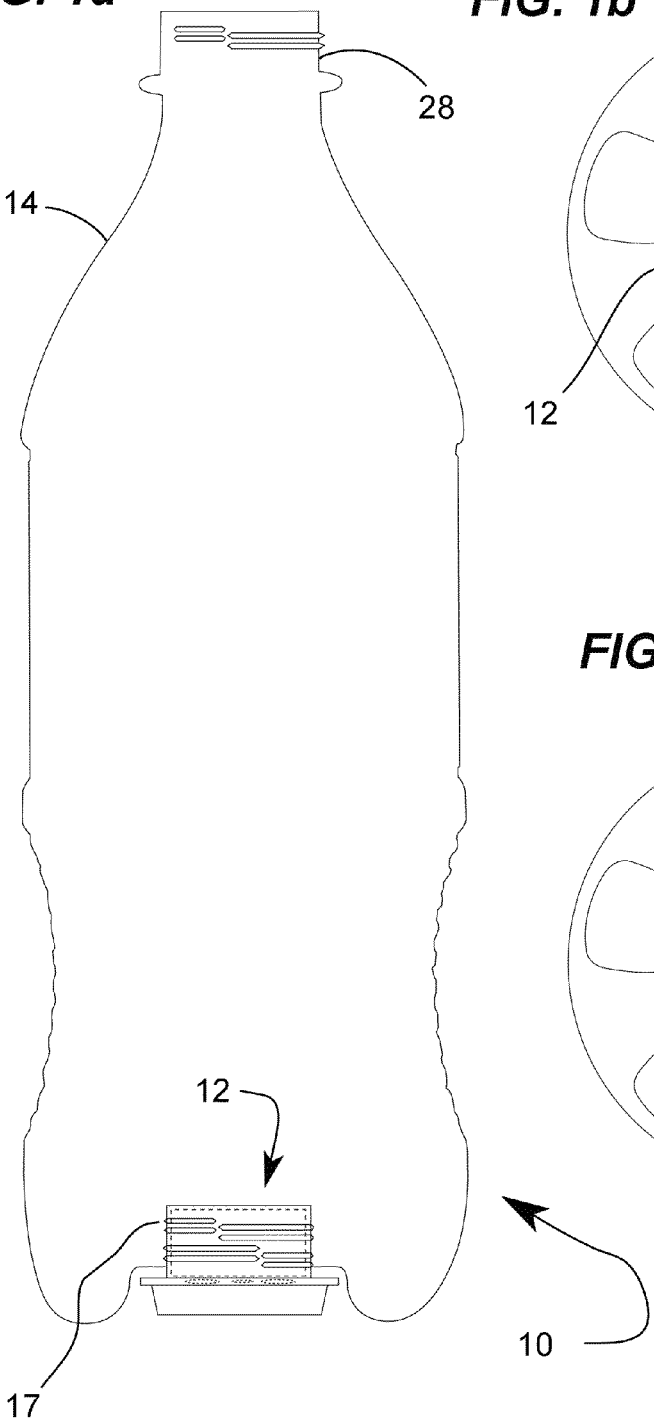
FIG. 1*a* Side elevation of the invention.

A bottle (10) than can transform into a whistle (12) consists in a vessel having a top portion and (14) having a whistle (12) located at its bottom portion. The whistle (12) has threads (16)

configured so as to threadably attach to complementary threads (17) that form an integral part of the bottom part of the vessel (12).

Figure 1B:
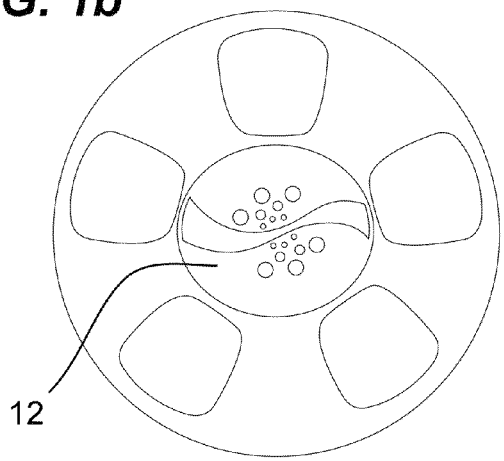
FIG. 1*b* Bottom view of the invention with the whistle in the closed position.
Figure 1C:
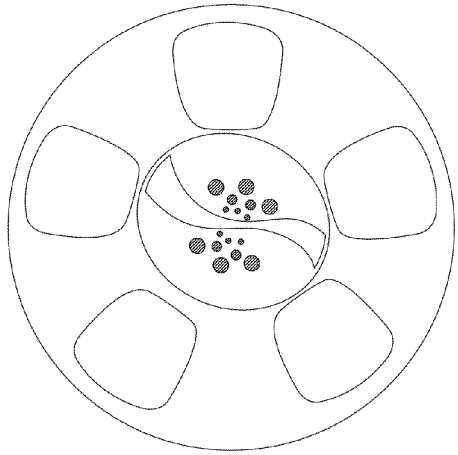
FIG. 1*c* Bottom view of the invention with the whistle in the open position.
Figure 1D:
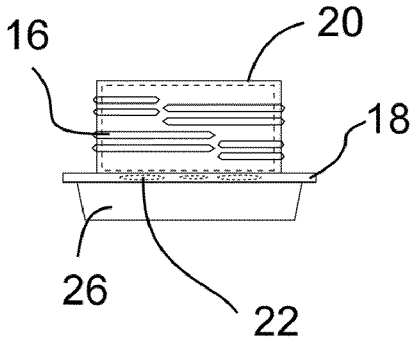
FIG. 1*d* Side view of the whistle cap.
Figure 1E:
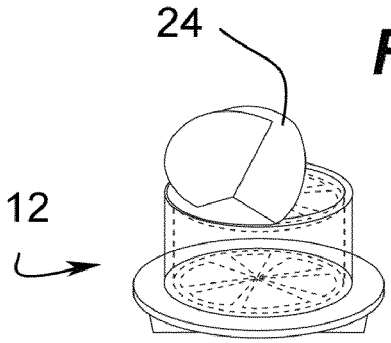
FIG. 1*e* Isometric view of the whistle cap.
Figure 1F:
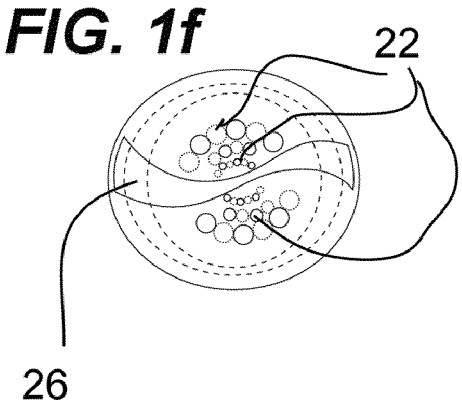
FIG. 1*f* Bottom view of the whistle cap in the closed position.
Figure 1G:
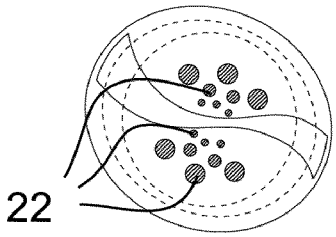
FIG. 1*g* Bottom view of the whistle cap in the open position.
Figure 2:
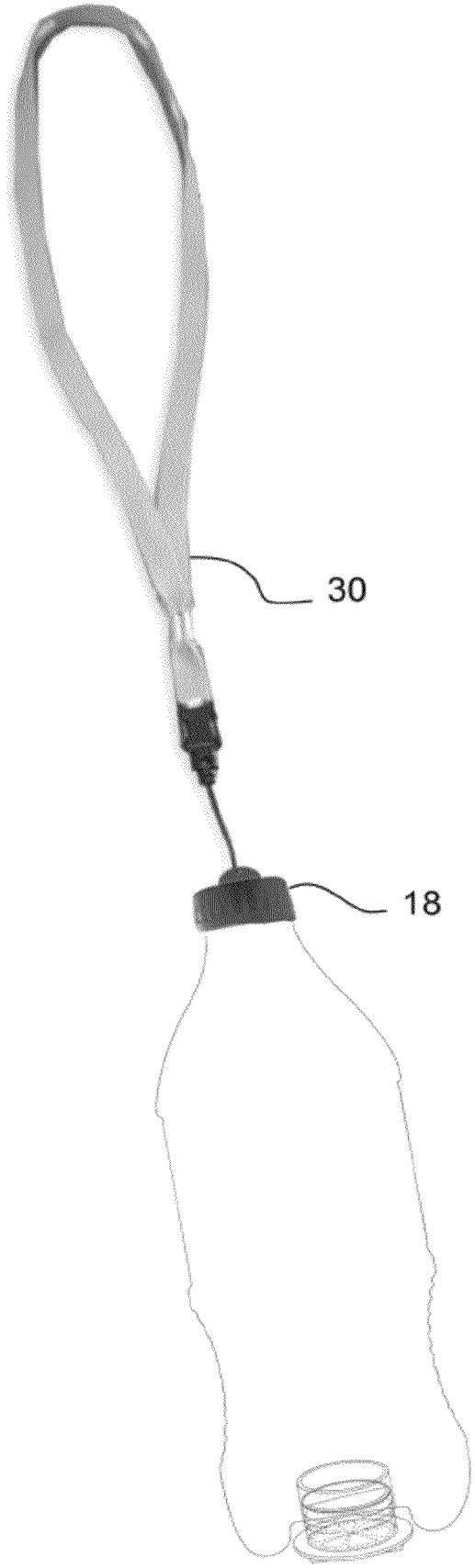
FIG. 2 Side view of a strap attached to the cap of the bottle.

The whistle (12) has a cap (18) which is rotationally attached to a threaded whistle body (20). The threaded whistle body (20) and the cap (18) each have at least one but preferably a plurality of holes (22) made therein. By rotating the cap (18) relative to the threaded whistle body (20), the holes (22) of each of the cap (18) and the threaded whistle body (20) can be aligned or not. When aligned, as per FIG. 1*c* or FIG. 1*g*, air passes through, when unaligned, as per FIGS. 1*b* and 1*f*, air cannot pass through. The whistling sound is of course produced when air passes through.

When purchasing a bottle (10), the user first needs to empty its content, generally by drinking it. Once the vessel (12) is empty, the whistle (12) can be un-threaded from the bottom of the vessel (12). A peel off pad (24), located on top of the whistle (12), is removed and the whistle is re threaded onto the bottom of the vessel (12). When re threading, the user uses a tab (26) to twist the whistle (12) up until a "click" is heard. This indicates that the holes (22) are aligned and that the whistle (12) is ready for use. The user then blows into the neck (28) of the vessel (14) to produce a sound. The use of the peel off pad (24) is of course to insure a proper seal to the vessel when it is originally filled with liquid. The "click" sound is produced by a ratchet like devices which prevents any further tightening as well as indicating, by way of sound that no further tightening is required. Since this feature is inspired by a similar feature found, for example on the cap of a car gas tank, it is of common knowledge and need not be further discussed herein. Additionally, a strap (30) can be attached to the cap (18).

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A bottle capable of producing a whistling sound, said bottle comprising:

a vessel adapted to hold a liquid therein and having a top portion and bottom portion, said top portion having an opening adapted for the injection of and the removal of said liquid, said bottom portion having an opening including threads;

a whistle member capable of producing a whistling sound, said whistle member including threads adapted to be removably attached to said opening of said bottom portion of said vessel by interacting with said threads of said opening, such that after said liquid is removed from said vessel said whistle can be removed from said bottom portion and used to produce whistling sounds;

a body portion which includes said threads, and further includes at least one hole adapted for air to pass therethrough; and a cap portion that is adapted to rotate with respect to said body portion and includes at least one hole adapted for air to pass therethrough, such that when said at least one hole of said cap portion is aligned with said at least one hole of said body portion air can pass therethrough and produce a whistling sound;

said cap portion of said whistle member further includes a tab member to aid in the rotation of said cap portion with respect to said body portion.

2. The bottle of claim 1, wherein said body portion of said whistle member further includes a peel off pad adapted to seal off said liquid from entering said whistle member when said vessel has liquid therein, and which is adapted to be peeled off of said body portion when the vessel is empty and when the whistle is removed and ready to be used to produce a whistling sound.

3. The bottle of claim 2, wherein said whistle member can be used by itself to produce a whistling sound.

4. The bottle of claim 2, wherein said whistle member can be reattached to said bottom portion of said vessel, such that said vessel and said whistle can be used together to produce a whistling sound.

5. The bottle of claim 4, wherein when said whistle member is reattached to said bottom portion of said vessel the tab member can be further rotated upon said body portion until the holes of said body portion and said tab member are aligned.

* * * * *